US005095967A

United States Patent [19]

Nagarwalla et al.

[11] Patent Number: 5,095,967

[45] Date of Patent: Mar. 17, 1992

[54] MODULAR CORE MAKING MACHINE

[75] Inventors: Pheroze J. Nagarwalla, St. Charles; Clyde Eicher, Naperville; Raymond F. Witte, Romeoville, all of Ill.

[73] Assignee: Disamatic, Inc., Oswego, Ill.

[21] Appl. No.: 639,149

[22] Filed: Jan. 9, 1991

[51] Int. Cl.[5] ..... B22C 11/00; B22C 13/12; B22C 15/24

[52] U.S. Cl. ..... 164/186; 164/201; 164/228

[58] Field of Search ..... 164/186, 228, 201, 200, 164/202

[56] References Cited

U.S. PATENT DOCUMENTS

| | | | |
|---|---|---|---|
| 2,901,791 | 9/1959 | Beech | 164/200 X |
| 4,082,134 | 4/1978 | Zachary | 164/186 X |
| 4,942,916 | 7/1990 | Hale et al. | 164/186 |

FOREIGN PATENT DOCUMENTS

| | | | |
|---|---|---|---|
| 55-36021 | 3/1980 | Japan | 164/201 |
| WO80/02520 | 11/1980 | PCT Int'l Appl. | 164/201 |
| WO80/02521 | 11/1980 | PCT Int'l Appl. | 164/201 |
| 2024070A | 1/1980 | United Kingdom | 164/200 |
| 2037201A | 7/1980 | United Kingdom | 164/186 |

OTHER PUBLICATIONS

Shell Core Systems Brochure, CE Cast Products.

*Primary Examiner*—J. Reed Batten, Jr.

*Attorney, Agent, or Firm*—Marshall, O'Toole, Gerstein, Murray & Bicknell

[57] ABSTRACT

An improved core making machine having a frame and capable of producing cores at a molding position within the frame is easily configured to include one or more horizontal core box handling components and/or one or more vertical core box handling components. The machine is readily adaptable to many different foundry needs.

23 Claims, 14 Drawing Sheets

MODULAR CORE MAKING MACHINE

TECHNICAL FIELD

The present invention relates generally to core making machinery, and more particularly to machines which are capable of producing sand cores used in casting processes.

BACKGROUND ART

Core making machines are employed to produce sand cores that are in turn used to produce voids or recesses in cast parts. Such machines typically inject specially prepared sand into a core box comprising first and second mating core box halves. Conventional machines are adapted to accommodate either horizontal-type core boxes having a horizontal parting line or vertical-type core boxes having a vertical parting line or both. In machines adapted to accommodate a horizontal-type core box, the core box is transported into the machine, the core box is elevated to a molding position, an upper half or cope of the core box is clamped and an injecting head injects sand into the core box. Following injection of sand, a gassing plate is moved into position above the core box and curing gas is injected into the core box to cure the cores. Thereafter, a lower half or drag of the core box is lowered away from the cope and the produced cores are retained in the drag. The drag is then transported out of the molding machine for removal of cores. Alternatively, the cores may be retained in the cope and thereafter removed using a core conveyor or a pick off unit.

In machines adapted to accommodate core boxes having a vertical parting line, the assembled core box is transported into the machine, the core box halves are clamped together using side platens and sand is injected into the core box. Curing of the cores in the box is then accomplished using the curing gas and the side platens and core box halves are thereafter moved away from one another. Ejector pins carried by one of the side platens and extending through the corresponding core box half carried thereby insure that the produced cores are retained within the other core box half. The platen carrying the other core box half is retracted by a first piston and cylinder unit and is tilted downwardly by a second piston and cylinder unit. The produced cores are then ejected onto a conveyor or other surface for further processing.

Machines have been devised which may be configured to accommodate either type of core box through the addition of a set of horizontal core box handling components or a set of vertical core box handling components. However, only one set of handling components can be mounted on the machine at a time while in use. As a consequence, the machine must be reconfigured whenever a different core box type is to be used. The time required to reconfigure the machine is significant. The foregoing core making machines are thus limited in their usefulness since such machines are limited in their adaptability to change from one type of core box handling capability to the other. In situations where jobbers or other manufacturers produce different cast parts requiring cores formed in both types of core boxes, two different machines must be purchased and maintained or long reconfiguration times are required. This is an obvious disadvantage which increases the ultimate cost of the cast parts.

Further, as far as applicants are now aware, there is no core making machine which can be readily adapted to add optional features which greatly improve the usefulness thereof.

SUMMARY OF THE INVENTION

In accordance with the present invention, a core making machine is flexible in design and thus capable of being adapted for use with both types of core boxes with minimal changeover time.

More particularly, an improvement in a core making machine having a frame and capable of producing cores at a molding position within the frame comprises first means mounted on the frame adjacent the molding position for applying pressure on a horizontal-type core box in a first direction and second means also mounted, on the frame adjacent the molding position for applying pressure on a vertical-type core box in a second direction transverse to the first direction.

The core making machine can optionally be configured to include one or more devices. Thus, a clamp may also be mounted on the frame wherein the clamp is capable of clamping a cope of a horizontal-type core box. Alternatively or in addition, the second means may comprise first and second vertical platens wherein the platens are movable relative to one another and wherein the platens are capable of supporting portions of a vertical-type core box. In this embodiment, one of the platens may be rotatable about a pivot axis so as to be capable of ejecting cores formed in a core box portion carried by the one platen and the machine may further include means disposed below the one platen for transporting cores.

In accordance with one embodiment of the present invention, the transporting means preferably comprises an indexing system for carrying cores between the molding position and a removal station. In accordance with a further embodiment, the transporting means comprises a conveyor for carrying cores away from the molding position.

Preferably, a shuttle system is mounted on the frame for transporting a core box toward and away from the molding position. If desired, means may be mounted on the frame for removing cores formed in a drag of a core box, such means preferably being in the form of a vacuum pick-off unit.

In accordance with a further aspect of the present invention, a core making machine includes a frame, an extruding head mounted on the frame for movement toward and away from a molding position, a shuttle capable of moving a core box into the molding position and a lifting platen carried by the frame for elevating a horizontal-type core box into a molding position. First and second vertical platens are also carried by the frame wherein the vertical platens are relatively movable and are capable of supporting portions of a vertical-type core box.

A clamp may be mounted on the frame wherein the clamp is capable of clamping a cope of a horizontal-type core box.

In accordance with an embodiment of the present invention, one of the vertical platens is rotatable about a pivot axis so as to be capable of ejecting cores formed in a core box portion carried by the one vertical platen and means are provided below the one vertical platen for transporting cores In one specific form of the present invention, the transporting means comprises an indexing system for carrying cores between a molding position and a removal station. In a further form of the invention, the transporting means comprises a conveyor for carrying cores away from the molding position.

Means may also be provided on the frame for removing cores formed in a drag of a core box, such means preferably comprising a vacuum pick-off unit.

In accordance with yet another aspect of the present invention, a core making machine for producing cores in a horizontal or vertical-type core box includes a frame, an extruding head carried by the frame and adapted to inject molding sand into a core box and horizontal core box handling apparatus and vertical core box handling apparatus carried by the frame. The horizontal core box handling apparatus includes a lifting platen for elevating a horizontal-type core box into a molding position and clamps are disposed adjacent the frame for clamping a cope of the core box. The vertical core box handling apparatus includes first and second vertical platens movable relative to one another and capable of supporting portions of a vertical-type core box. The horizontal core box handling apparatus is positioned so that it does not interfere with a vertical-type core box during production of cores in the latter and the vertical core box handling apparatus is positioned so that it does not interfere with a horizontal-type core box during production of cores therein.

The core making machine may further include a shuttle system capable of transporting a core box toward the molding position. Also, in accordance with one form of the present invention, one of the platens is pivotable about an axis between an upright orientation and a downward orientation and an actuator is coupled to the one vertical platen that controls pivoting of the one vertical platen. Further, a conveyor may be disposed below the one vertical platen and the conveyor may be movable between upper and lower positions by a further actuator.

If desired, an indexing system may alternatively be disposed below the one vertical platen. Also, a vacuum pick-off unit may be disposed adjacent the frame, if desired.

The core making machine of the present invention can be easily customized to suit the needs of a particular user. For example, where only core boxes of a single type are to be accommodated, only the apparatus required to handle the core box in the desired fashion need be added to the basic machine. Since only those components necessary to undertake a particular function are used in the machine, overall cost is decreased. Further, additional capability can be added at a later date in ready fashion. In addition, different core box types can be accommodated with only minimal time spent reconfiguring the machine.

DESCRIPTION OF THE PREFERRED EMBODIMENTS

Figure 1:
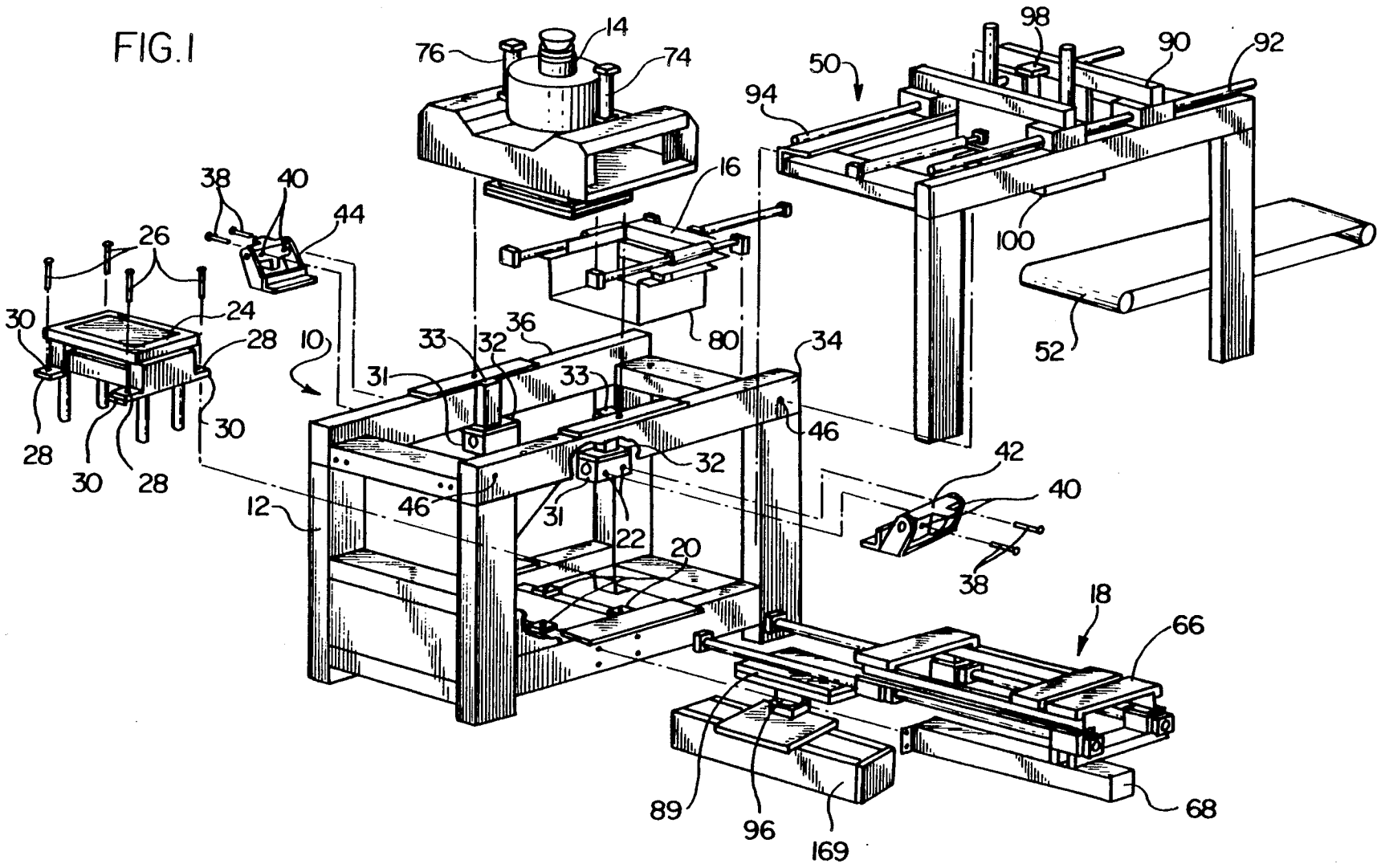
FIG. 1 comprises an exploded perspective view of a core making machine according to the present invention with portions broken away to reveal components therein.

Referring now to FIG. 1, a core molding machine 10 useful in the production of sand cores includes a frame 12, an extruding head 14 mounted on the frame 12 and a gassing plate assembly 16 mounted on the frame 12 by bolts or other fasteners. A shuttle system 18 is also fastened to the frame 12 and is capable of transporting a core box toward and away from a molding position within the frame 12. The shuttle system 18 is described in greater detail in Witte, et al. co-pending application Ser. No. 07/627,342, filed Dec. 14, 1990, entitled "Core Box Shuttle System" assigned to the assignee of the instant application and the disclosure of which is hereby incorporated by reference herein.

The frame 12 further includes means for accepting at least one horizontal core box handling component for mounting on the frame 12. As seen in FIG. 1, such means comprises one or more bores or holes 20, 22. The bores or holes 20 are used to mount a lifting platen 24 to the frame 12 by means of bolts 26 that extend through holes 28 in flanges 30 aligned with the bores or holes 20.

First and second stop blocks 31 are bolted to plates 32 (only one of which is visible in FIG. 1) which are in turn welded to upper cross members 34, 36 of the frame 12. Stiffeners 33 may be welded to the plates 32 and the frame 12. The holes 22 are formed in the stop blocks 31. Bolts 38 extend through holes 40 formed in first and second clamps 42, 44 into the holes 22 in the stop blocks 31.

The frame 12 may include further bores or holes 46 which are used to mount an optional transport mechanism in the form of a vacuum pick-off unit 50 to the frame 12 by bolts or other fasteners. As noted in greater detail hereinafter, the vacuum pick-off unit 50 removes cores from a drag of a core box and places the removed cores on a conveyor 52 for further processing.

Figure 2:
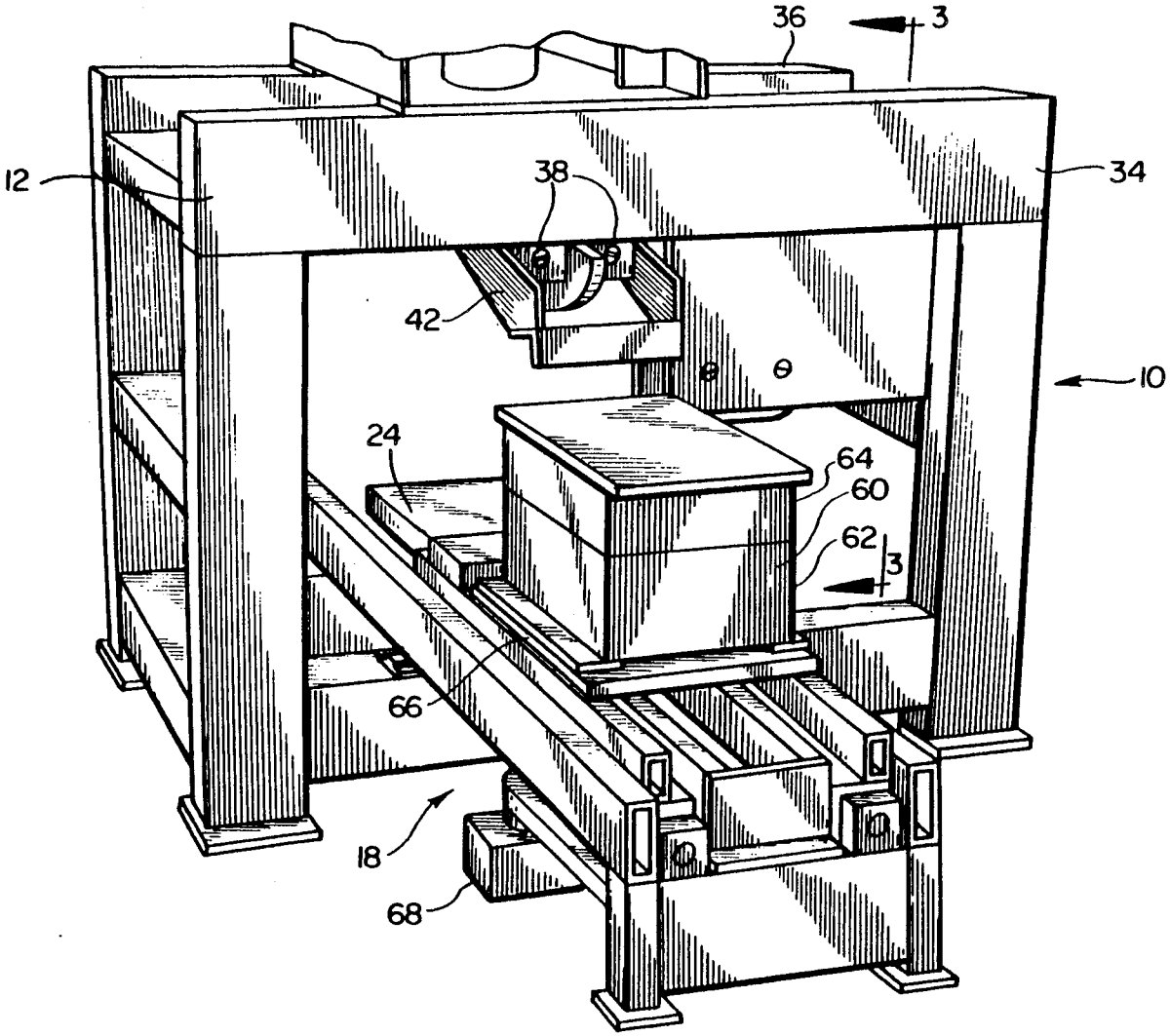
FIG. 2 comprises a fragmentary perspective view of the core making machine of FIG. 1 during operation thereof.
Figure 3:
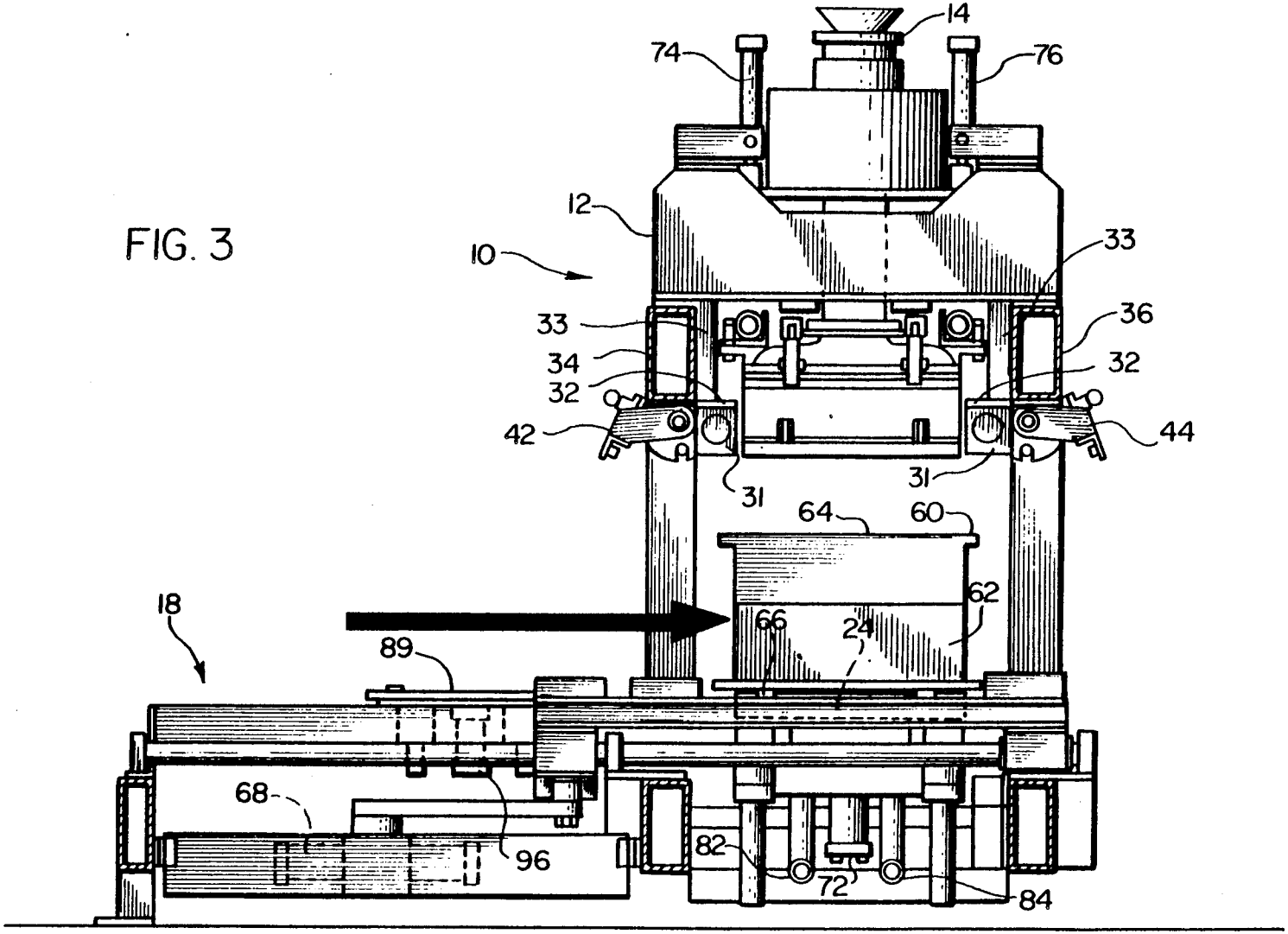
FIGS. 3–6 are sectional views taken generally along the lines 3—3 of FIG. 2 illustrating a sequence of steps effected by the core making machine of the present invention.
Figure 4:
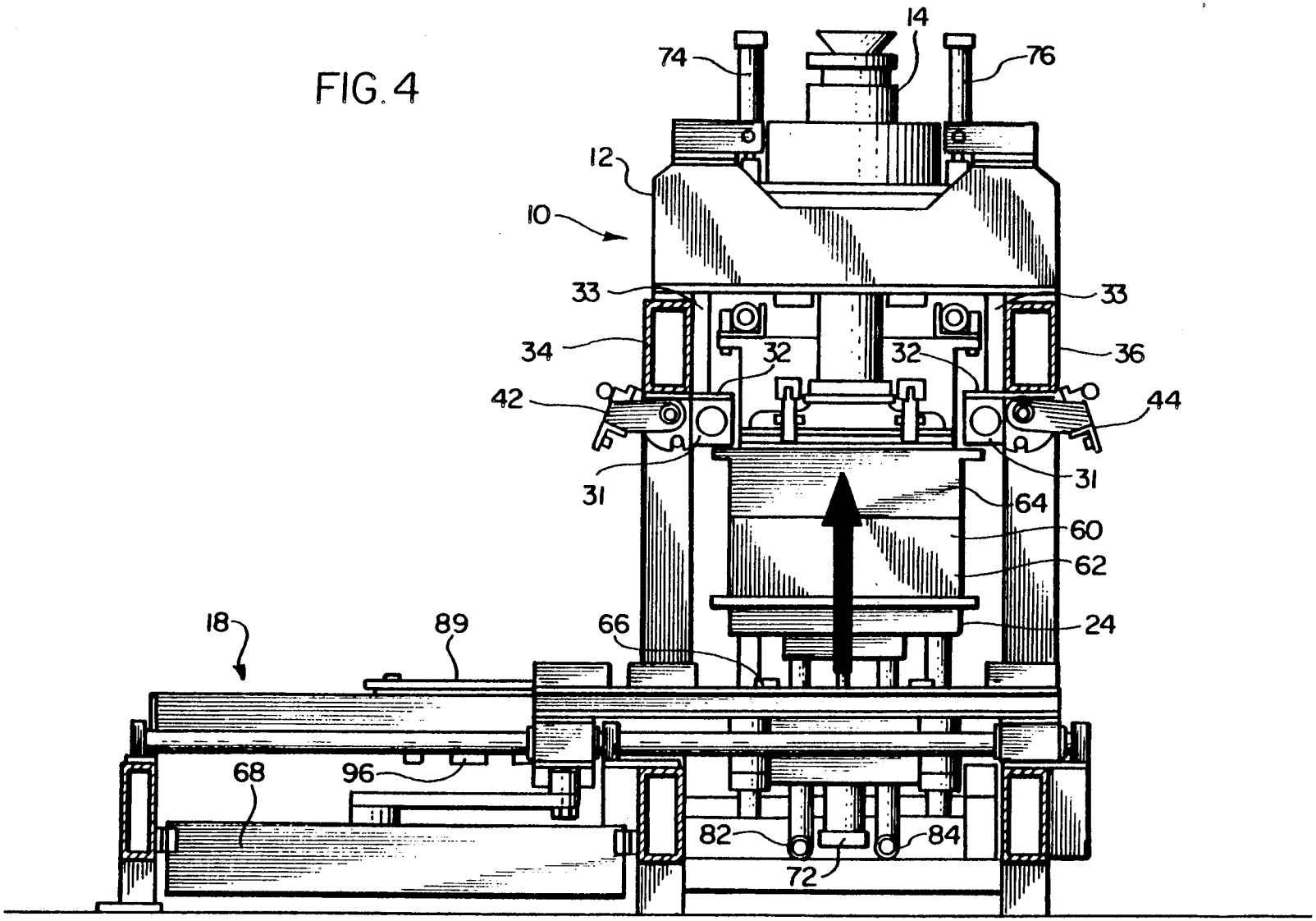

Referring now to FIG. 2, the core molding machine is readied for operation by placing a core box 60 having a lower portion or drag 62 and an upper portion or cope 64 on a shuttle car 66 of the shuttle system 18. An actuator 68 is then operated to move the shuttle car 66 and the assembled core box 60 toward the molding position within the frame 12. The shuttle car 66 is moved until the core box 60 assumes the position shown in FIG. 3. Thereafter, an actuator 72 is operated to raise the lifting platen 24 and the core box 60 to the molding position, as seen in FIG. 4.

Following operation of the actuator 72, the extruding head 14 is moved downwardly by means of first and second piston and cylinder units 74, 76 into engagement with the cope 64 of the core box 60. The design and operation of the apparatus for moving the extruding head is described in greater detail in Witte, U.S. patent application Ser. No. 07/627,411, filed Dec. 14, 1990, "Mounting Apparatus For A Molding Machine Extruding Head", assigned to assignee of the instant application and the disclosure of which is hereby incorporated by reference herein. Briefly, the actuator 72 applies upward pressure on the core box 60 to force the core box against the stop blocks 31. The extruding plate 80 of the extruding head 14 also applies pressure down on the core box 60. Sand is then injected through apertures in the cope 64 into the core box 60. Following injection of sand, the extruding head 14 is retracted away from the core box 60 and the gassing plate assembly 16 is moved into engagement with the upper surface of the cope 64. The gassing plate assembly 16 injects curing gas through the apertures in the cope 64 to thereby cure the cores formed therein. The curing gasses are thereafter exhausted through exhaust tubes 82, 84 which are in fluid communication with further apertures in the drag 60.

Figure 5:
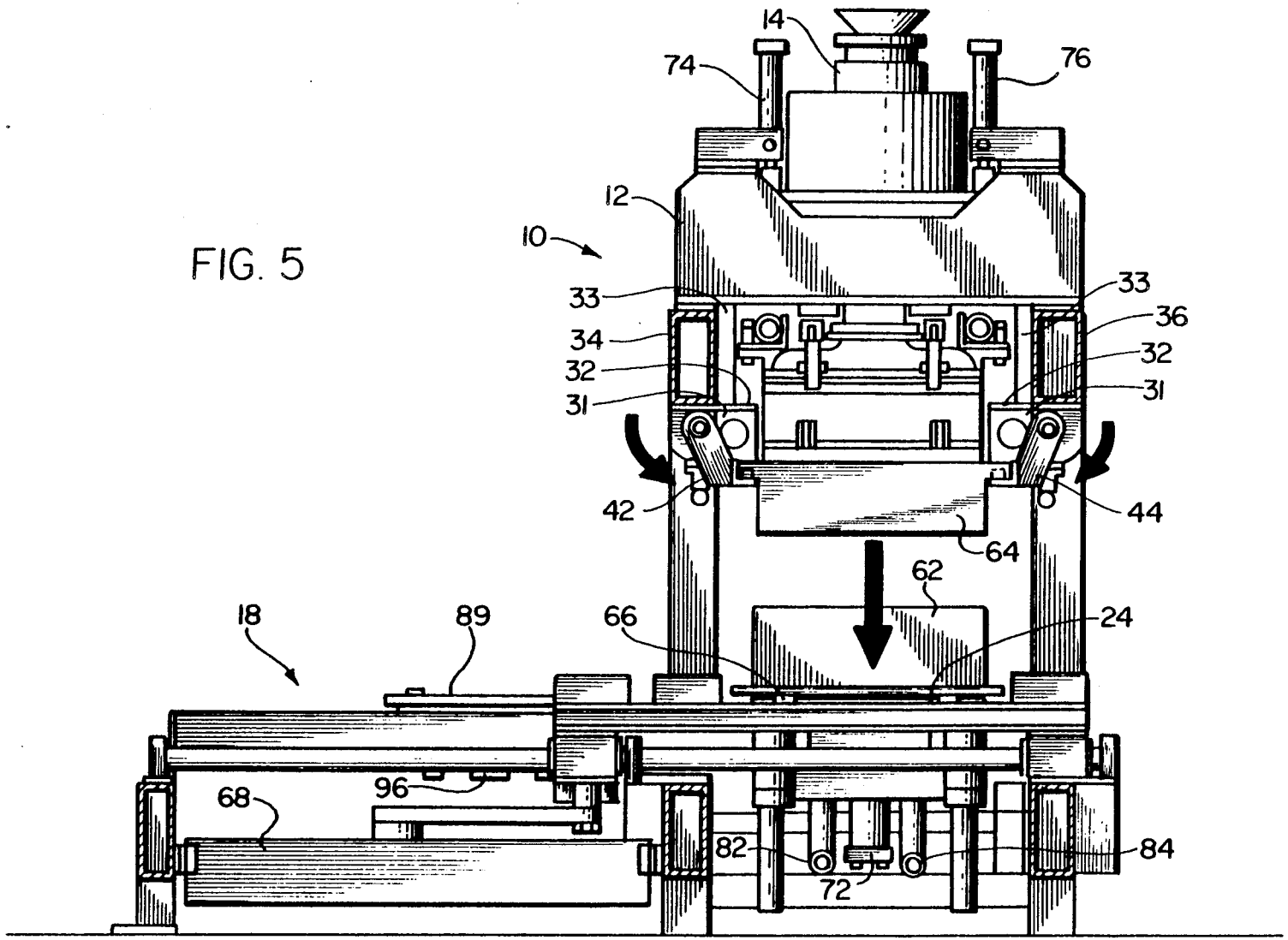

Following the gassing operation, and as seen in FIG. 5, the actuator 72 retracts the lifting platen 24 and the drag 62. The clamps 42, 44 maintain the cope 64 in an elevated position so that the cope 64 and drag 62 are separated from one another. The cores at this time are retained within the drag 62.

Figure 6:
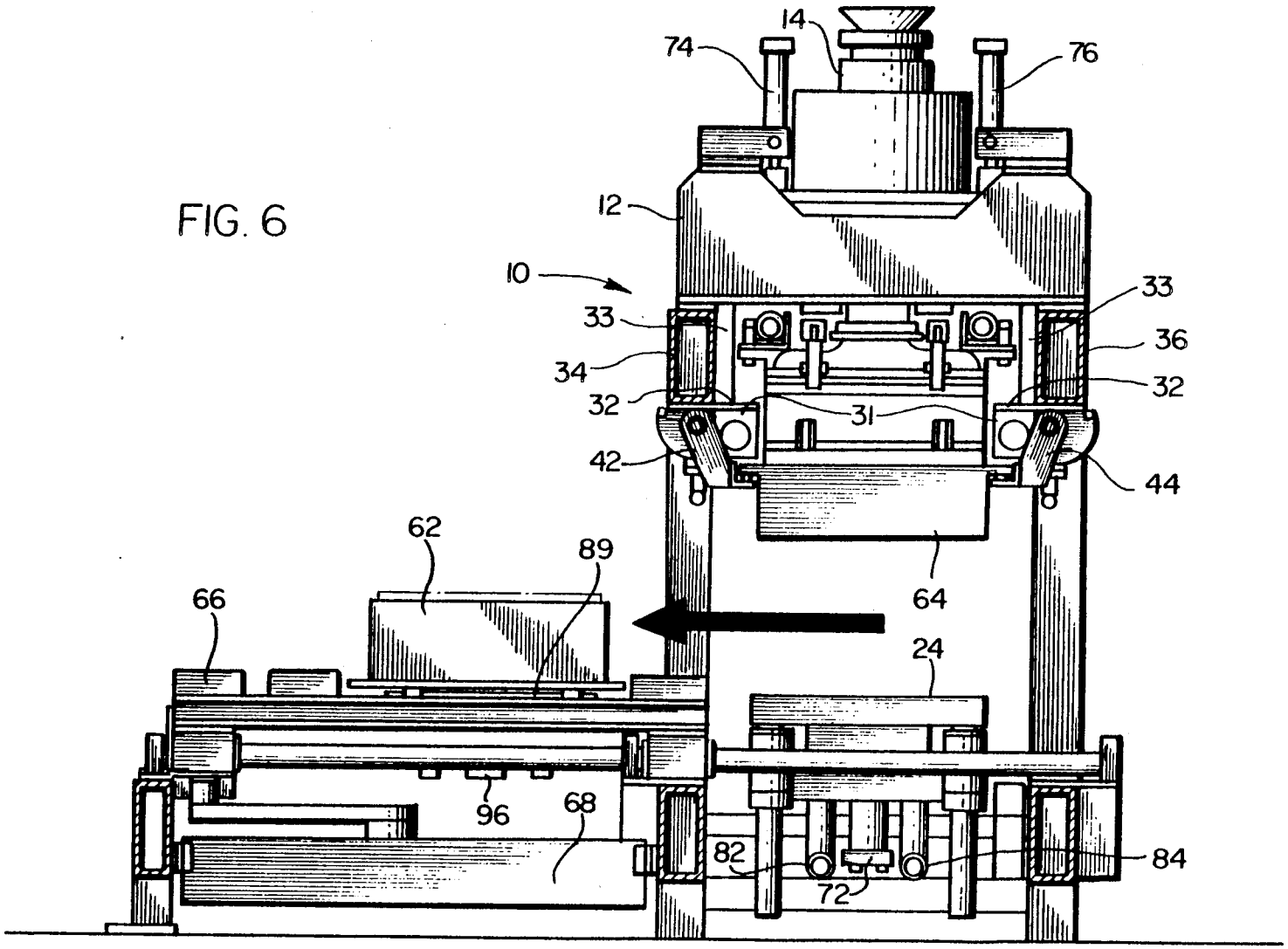
Figure 7:
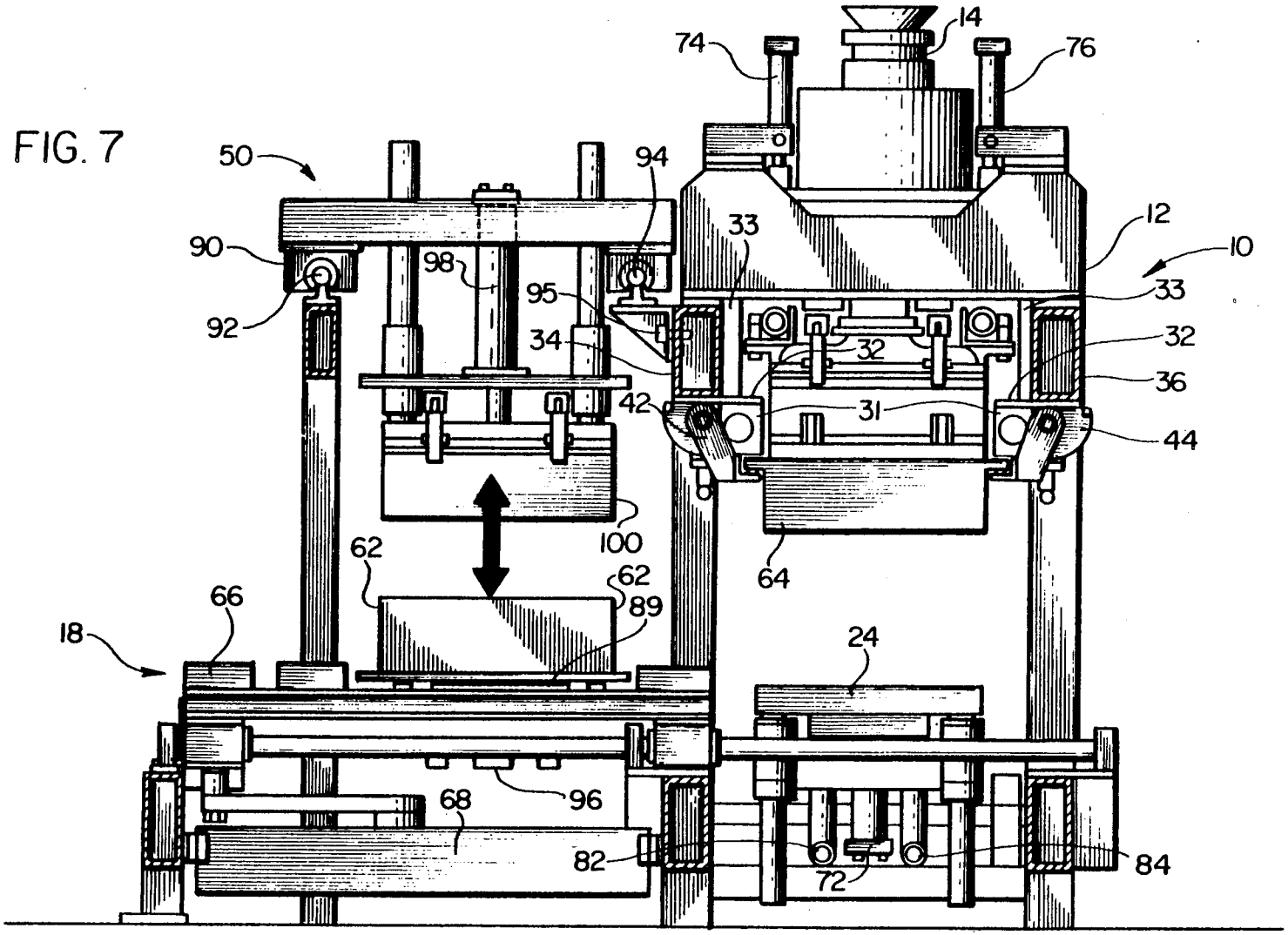
FIG. 7 is a sectional view similar to FIGS. 3–6 illustrating removal of cores by a vacuum pick-off unit.

As seen in FIG. 6, the actuator 68 is then operated to move the shuttle car 66 and the drag 62 away from the molding position. The cores produced and retained within the drag 62 are ejected by a drag ejector plate 89 and may then be manually removed. If desired, and as seen in FIG. 7, the cores may alternatively be removed by the vacuum pick-off unit 50. The vacuum pick-off unit 50 includes a movable carriage 90 mounted on guide rails 92, 94 and can be moved by an actuator (not shown) between a pick-off position directly above the shuttle system 18 and a drop-off position above the conveyor 52. As previously noted, the pick-off unit 50 is mounted to the frame 12, and more particularly the upper cross-member 34, by bolts 95, only one of which is visible in the Figures. During operation of the machine shown in FIG. 7, the shuttle car 66 and the drag 62 with cores formed therein are moved to the position shown in FIG. 7 directly above the drag ejector plate 89. An actuator 96 is operated to elevate the drag ejector plate 89 while a further actuator 98 is operated to advance a vacuum pick-off head 100 toward the cores in the drag 62. When contact is made between the head 100 and the cores in the drag 62, a vacuum is applied to the cores to remove same from the drag 62. The carriage 90 is then moved to a position over the conveyor 52, FIG. 1, at which point the head 100 is lowered. When the head 100 and cores are on or near the conveyor 52, the vacuum is removed, thereby releasing the cores onto the conveyor 52 for removal and/or further processing.

Following the sequence of steps illustrated in FIGS. 1–7, the drag ejector plate 89 is retracted by the actuator 96 to the position shown in FIG. 7 and the actuator 68 is operated to return the drag to the position within the frame 12 illustrated in FIG. 5, at which point further production of cores can take place.

Figure 8:
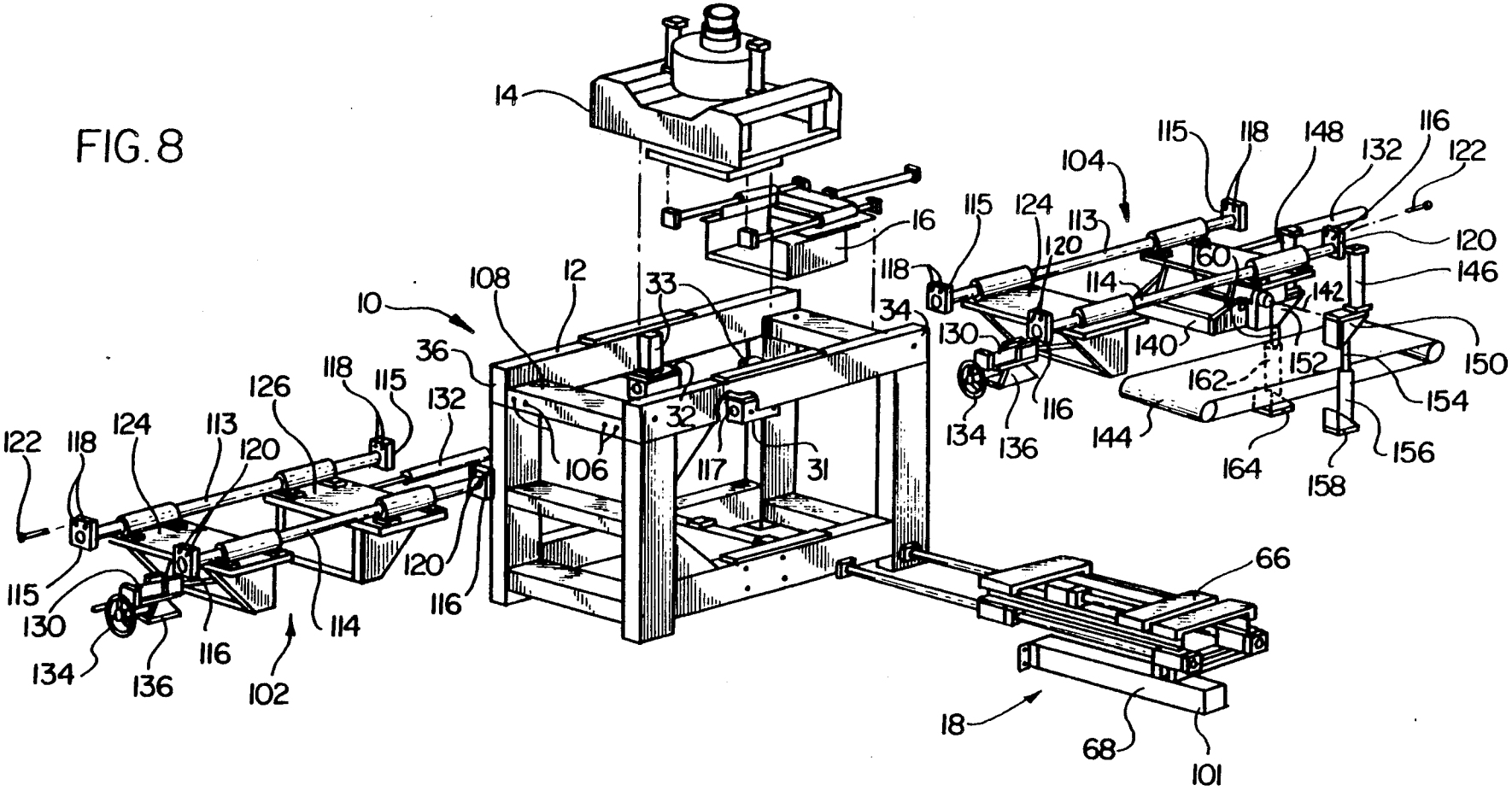
FIG. 8 comprises an exploded perspective view of the core making machine in conjunction with handling apparatus for handling a vertical-type core box with portions broken away to reveal components therein.

FIG. 8 illustrates modifications which may effected to the machine 10 to accommodate a vertical-type core box having a vertical parting line. As noted previously, the machine 10 includes the frame 12 having the upper cross members 34, 36 together with the stop blocks 31 and the plates 32 (shown in FIGS. 3–7) that mount the stop blocks 31 on the cross-member 34. Also included is the extruding head 14, the gassing plate assembly 16 and the shuttle system 18 mounted on the frame 12. The machine 10 can be adapted to permit manual removal of cores from a vertical-type core box, in which case a first platen assembly 102 is mounted on the frame 12, or may permit automatic removal of cores, in which case a second platen assembly 104 is mounted on the frame 12.

The frame 12 includes bores or holes 106 in an outer face of a cross-tie 108 and corresponding holes 110 (FIG. 13) in an outer face of a cross-tie 112. The first platen assembly 102 includes first and second guide rails 113, 114 which extend through bores 117 in the stop blocks 31. Disposed on the ends of the guide rails 113, 114 are mounting plates 115, 116, respectively, each having holes 118, 120, respectively, which are aligned with the holes or bores 106 and 110. Bolts 122, one of which is seen in FIG. 8, extend through the holes 118, 120 into the holes 106, 110 to secure the first platen assembly 102 to the frame 12.

Disposed on the guide rails 113, 114 are first and second vertical platens 124, 126 which are movable relative to one another on the guide rails 113, 114. As noted in greater detail hereinafter, the vertical platens 124, 126 are capable of supporting portions of a vertical-type core box for the production of cores.

An actuator 130 controls movement of the platen 124 while a further actuator 132 controls movement of the platen 126. A hand wheel 134 of an adjusting apparatus 136 may be rotated to control the travel distance of the platen 124 allowing variations of core box thickness.

The second platen assembly 104 is similar to the first platen assembly 102 in that it includes the guide rails 113, 114, the mounting plates 115, 116, the mounting holes 118, 120, the first vertical platen 124, the actuator 130, the hand wheel 134 and the adjusting apparatus 136. The second platen assembly is mounted by the bolts 122 extending through the holes 118, 120 into the holes 106, 110 of the frame 12. However, the second vertical platen 126 is replaced by a pivotable platen 140 which is pivotable about a pivot axis 142. The pivotable platen 140 is moved by the actuator 132 along the guide rails 113, 114 and, as such movement occurs, the platen 140 pivots about the axis 142 from an upright orientation to a downward orientation as seen in FIG. 8. Means in the form of a conveyor 144 is disposed below the platen 140 for transporting cores deposited from the core box portion carried by the platen 140 for further processing.

As noted in greater detail hereinafter, the conveyor 144 is movable upwardly and downwardly by a pair of actuators 146, 148 which are in turn mounted in shoes 150, 152 bolted to the frame 12 (best seen in FIG. 13). A guide rod 154 is telescoped within a guide tube 156 that is in turn welded or otherwise secured to a shoe 158. A corresponding guide rod 160 is telescoped within a guide tube 162 which is in turn welded or otherwise secured to a shoe 164. The shoes 158, 164 are secured to a frame 166, FIG. 13, that in turn supports the conveyor 144.

Figure 9:
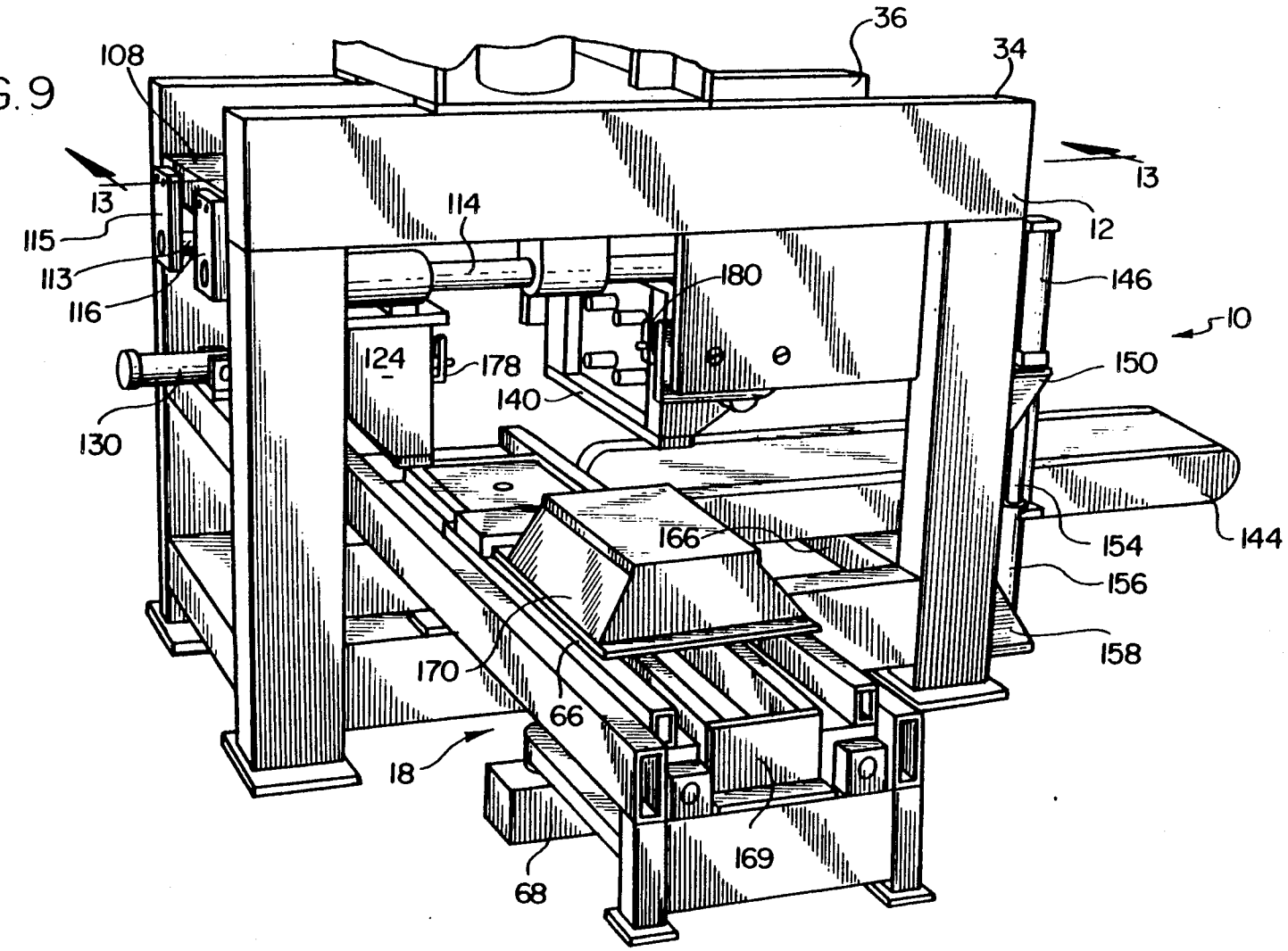
FIGS. 9–12 comprise perspective views illustrating operation of the core making machine of FIG. 8 wherein some elements of the machine are not shown for the sake of unity.
Figure 10:
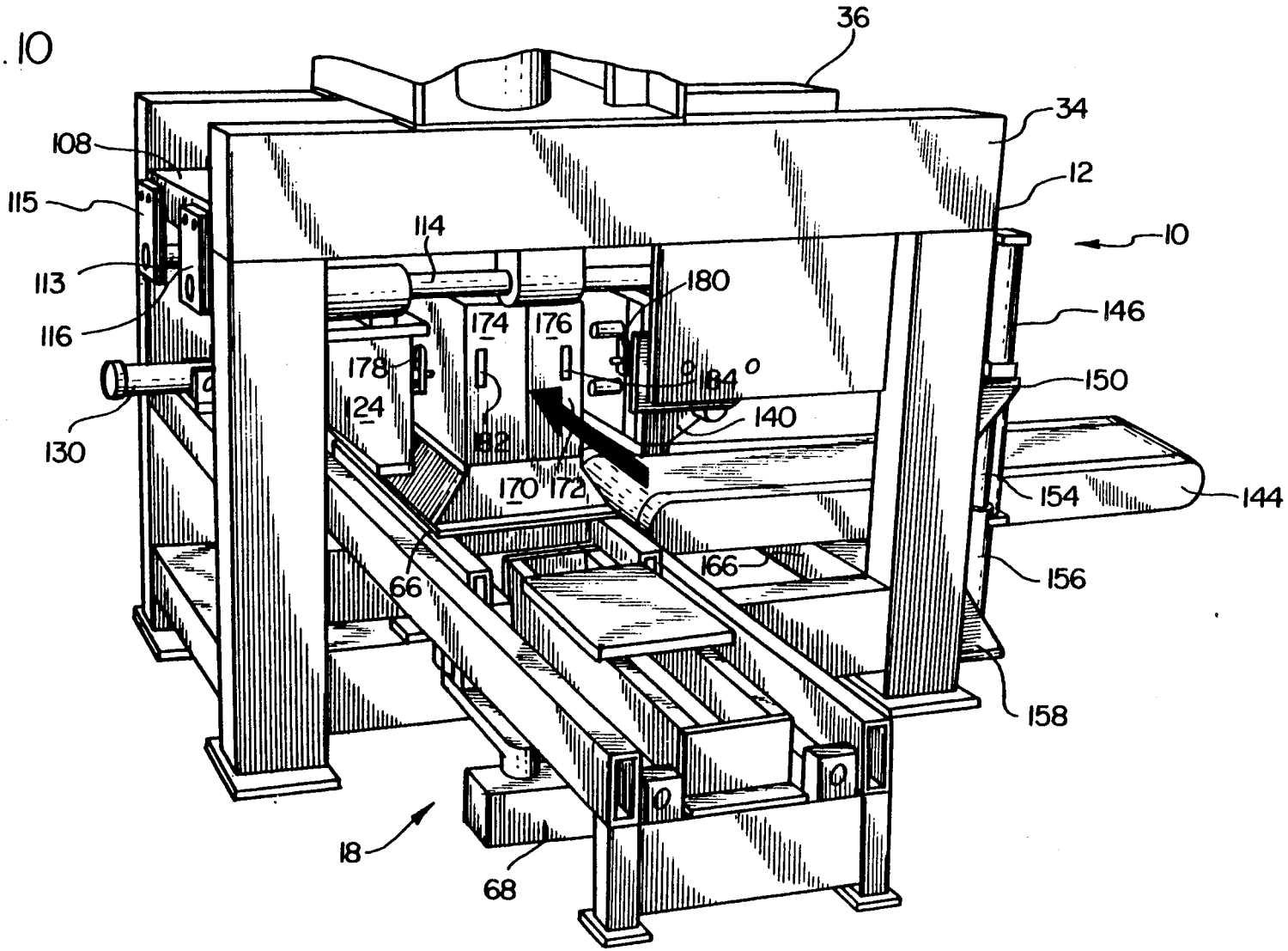
Figure 11:
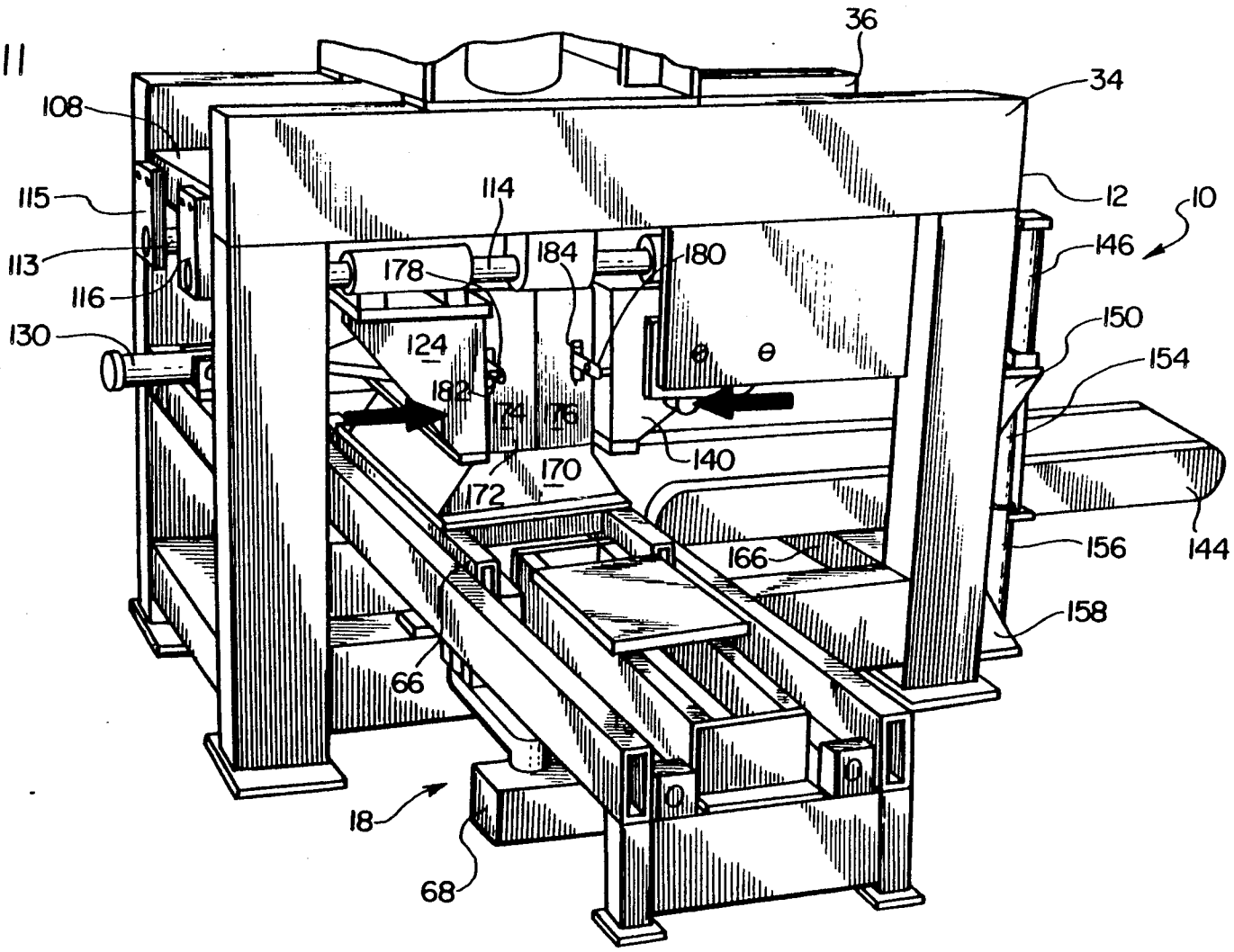

FIGS. 9–13 illustrate operation of the machine 10 utilizing the second platen assembly 104. Although the drag ejector plate 89 and support 169 therefore are shown in FIGS. 9–13, it should be noted that these structures are not used in the machine when configured to accommodate only vertical-type core boxes. Referring first to FIG. 9, a stool 170 is placed on the shuttle car 66, a core box 172 having core box portions 174, 176 is placed on the stool 170 and the actuator 68 is operated to move the stool 170 and the core box 172 to the molding position seen in FIG. 10. As seen in FIG. 11, the actuators 130, 132 are operated to advance the platens 124, 140 toward one another into engagement with the core box portions 174, 176. As seen in FIGS. 10 and 11, clamps 178, 180 carried by the platens 124, 140 are then rotated either manually or automatically into recesses 182, 184 in the core box portions 174, 176, respectively, to clamp the core box halves to the respective platens 124, 140.

The platens 124, 140 are then retracted from one another and ejector pins (not shown) in the platen 124 are operated to push the produced cores so that they remain in core box portion 176.

Figure 12:
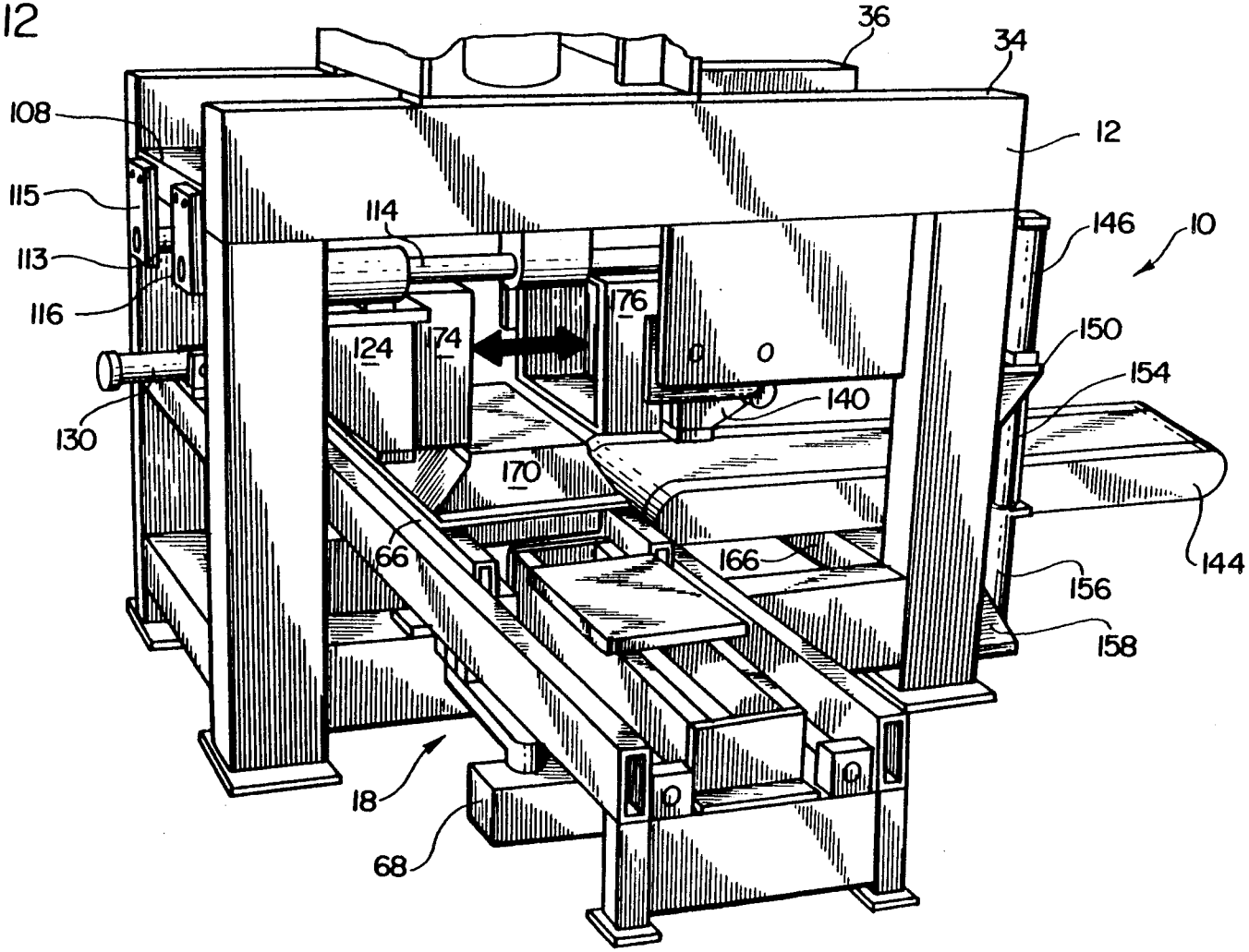
Figure 13:
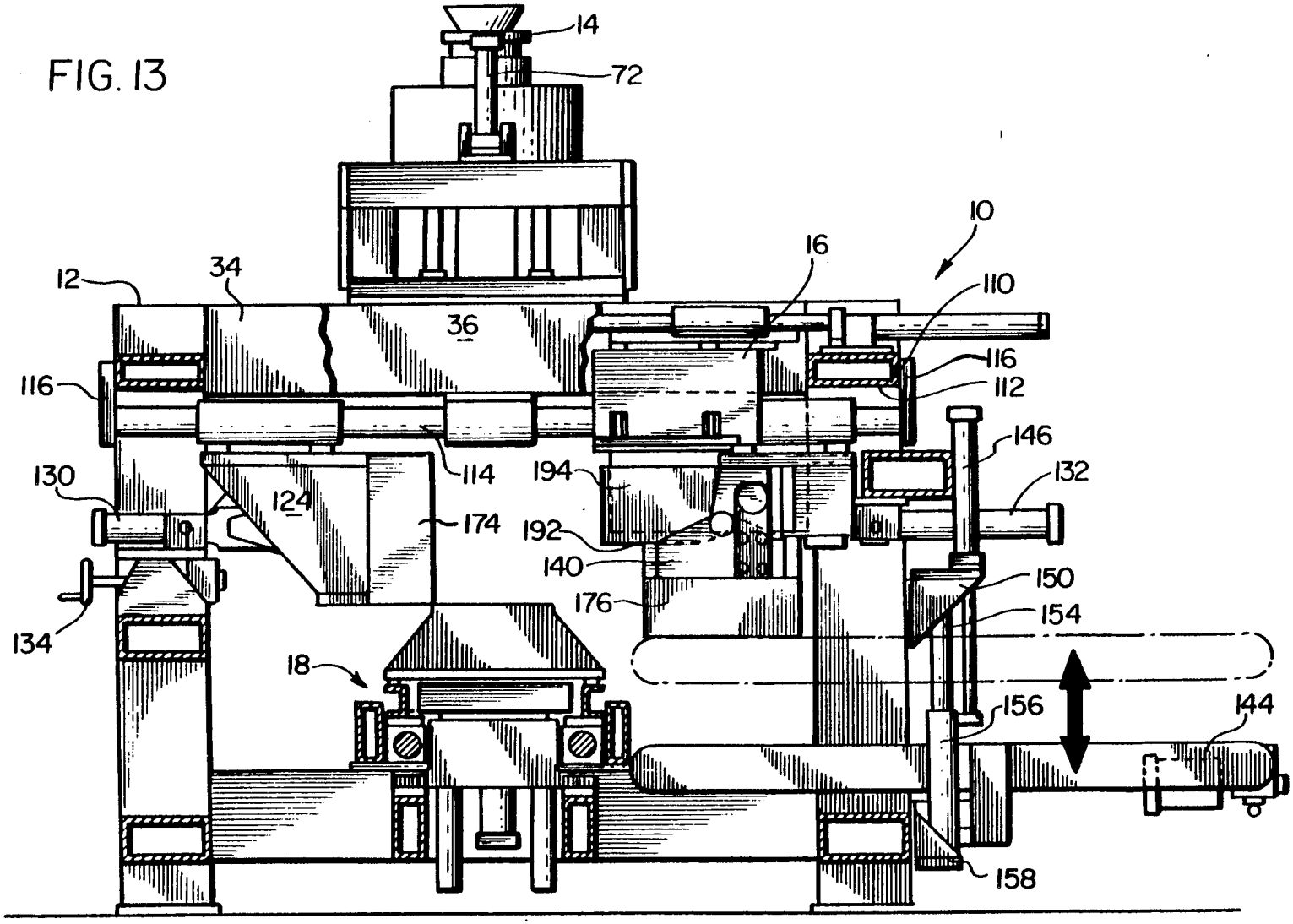
FIG. 13 comprises a fragmentary sectional view taken generally along the lines 13—13 of FIG. 9 wherein a core box is shown diagrammatically.

Referring specifically to FIGS. 12 and 13, as the platen 140 and the core box portion 176 are retracted by the actuator 132, a pair of rollers 190 (only one of which is visible in FIG. 13) carried by brackets mounted by the platen 140 roll over cam surfaces 192 of a pair of cam plates (again, only one of the cam plates 194 is visible in the Figures), thereby permitting the platen 140 to rotate to the downward orientation seen in FIG. 13. Following rotation of the platen 140, the conveyor 144 is raised so that cores retained in the core box portion 176 may be ejected thereon without damage. The cores may then be transported away by the conveyor 144 for further processing.

Following the foregoing sequence of steps, the conveyor 144 is lowered to the position shown in FIG. 13 and the actuator 132 is operated to extend the platen 140 toward the platen 124. Riding of the rollers 190 on the surfaces 192 causes the platen 140 to rotate about the pivot axis 142, in turn returning the platen 140 to the upright orientation as the platen 140 moves toward the platen 124.

The operation of the core box handling apparatus of FIGS. 9–13 is described in greater detail and Moonert, et al. co-pending application Ser. No. 07/639,042, filed Jan. 9, 1991, entitled "Core Box Handling Apparatus For A Core Molding Machine", assigned to the assignee of the instant application and the disclosure of which is hereby incorporated by reference herein.

Operation of the first platen assembly 102 is essentially identical to that described above for the second platen assembly 104, except that no tilt-down function is undertaken, nor are cores ejected onto a conveyor. Instead, following production of cores in the core box, the platens 124, 126 are retracted from one another, thereby retracting the core box portions 174, 176 from one another. In this embodiment, ejector pins in the core box portions 174, 176 ensure that the produced cores are maintained on one or more mandrels disposed on the stool 170. The shuttle system 18 may then be operated to remove the produced cores from within the frame for manual removal from the mandrels.

Figure 14:
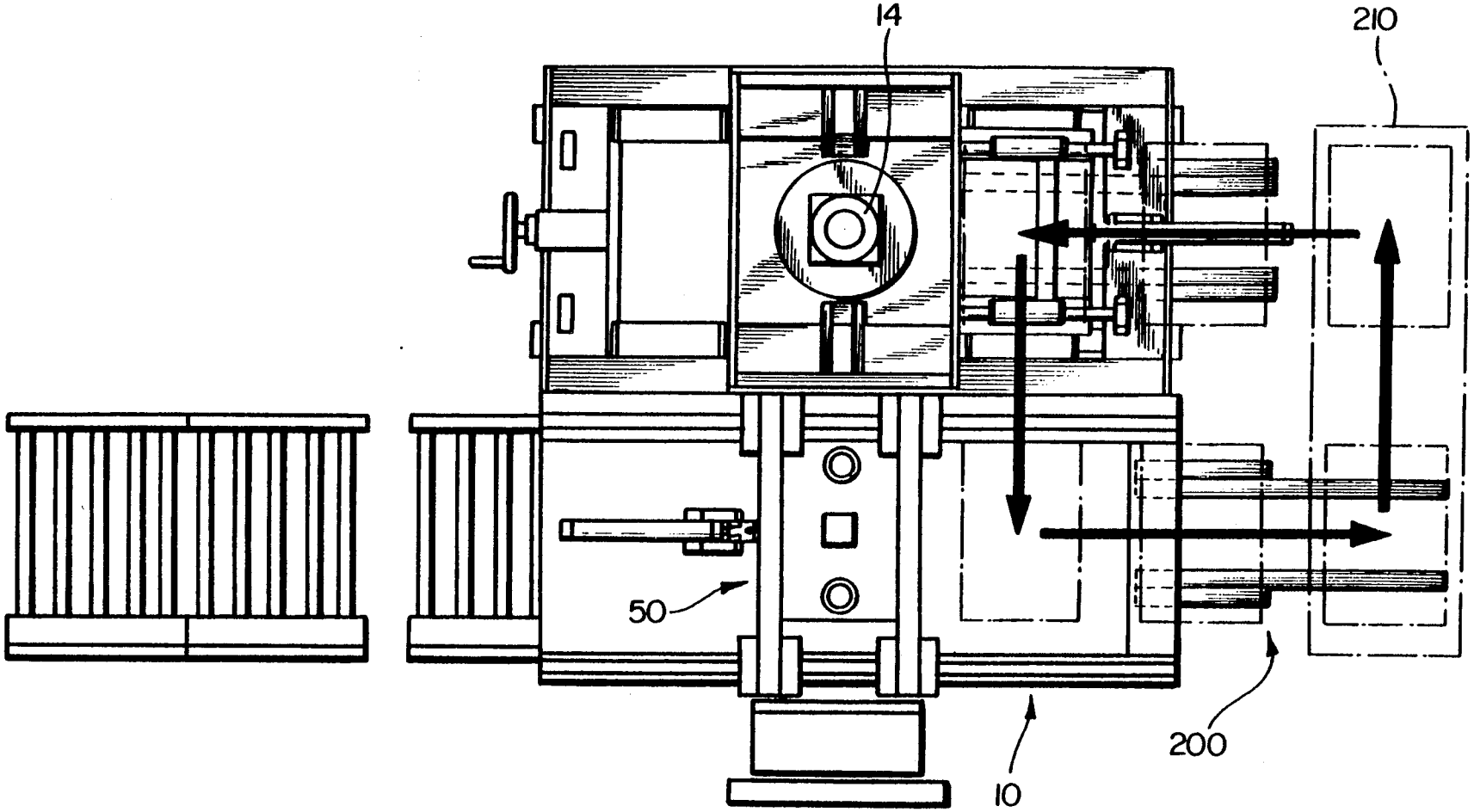
FIG. 14 comprises a diagrammatic plan view of a further embodiment of the present invention.

FIG. 14 illustrates a modification of the machine of FIGS. 9–13 wherein an indexing system 200 replaces the conveyor 144. In this case, the platen 140 deposits produced cores on moving stations of the indexing system. A walking beam transfers the cores to a removal station comprising a moving conveyor 210, at which point the cores can be removed for further processing.

It should be noted that the machine 10 can include varying combinations of elements shown in the figures. Thus, for example, the machine 10 may include the components of FIGS. 2–5 and 6–13 so that vertical and horizontal cores can be accommodated. In this case, the vertical core box handling components do not interfere with the horizontal core box handling components while in use, and vice versa. Alternatively, a machine having the capabilities of handling only horizontal-type core boxes or only vertical-type core boxes can be assembled. The machine is readily adaptable to different foundry needs so that a single machine can serve many purposes.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. In a core making machine having a frame and capable of producing cores at a molding position within the frame, the improvement comprising:

first means mounted on the frame adjacent the molding position for applying pressure on a horizontal-type core box in a first direction; and second means also mounted on the frame adjacent the molding position for applying pressure on a vertical-type core box in a second direction transverse to the first direction.

2. The improvement of claim 1, wherein the first means comprises a lifting platen mounted on the frame and capable of lifting a horizontal-type core box and a clamp also mounted on the frame and capable of clamping a cope of a horizontal-type core box.

3. The improvement of claim 1, wherein the second means comprises first and second vertical platens mounted on the frame and movable relative to one another wherein the platens are capable of supporting portions of a vertical-type core box.

4. The improvement of claim 3, wherein one of the platens is rotatable about a pivot axis so as to be capable of ejecting cores formed in a core box portion carried by the one platen and further in combination with means disposed below the one platen for transporting cores.

5. The improvement of claim 4, wherein the transporting means comprises an indexing system for carrying cores between the molding position and a removal station.

6. The improvement of claim 4, wherein the transporting means comprises a conveyor for carrying cores away from the molding position.

7. The improvement of claim 1, in combination with a shuttle system mounted on the frame for transporting a core box toward and away from the molding position.

8. The improvement of claim 1, in combination with means mounted on the frame for removing cores formed in a drag of a core box.

9. The improvement of claim 8, wherein the removing means comprises a vacuum pick-off unit.

10. A core making machine, comprising:

a frame;

an extruding head mounted on the frame for movement toward and away from a molding position;

a shuttle capable of moving a core box into the molding position;

a lifting platen carried by the frame for elevating a horizontal-type core box into a molding position; and first and second vertical platens also carried by the frame and movable relative to one another and capable of supporting portions of a vertical-type core box.

11. The core making machine of claim 10, further including a clamp also mounted on the frame and capable of clamping a cope of a horizontal-type core box.

12. The core making machine of claim 10, wherein one of the vertical platens is rotatable about a pivot axis so as to be capable of ejecting cores formed in a core box portion carried by the one vertical platen and further including means disposed below the one vertical platen for transporting cores.

13. The core making machine of claim 12, wherein the transporting means comprises an indexing system for carrying cores between the molding position and a removal station.

14. The core making machine of claim 12, wherein the transporting means comprises a conveyor for carrying cores away from the molding position.

15. The core making machine of claim 12, in combination with means mounted on the frame for removing cores formed in a drag of a core box.

16. The core making machine of claim 15, wherein the removing means comprises a vacuum pick-off unit.

17. A core making machine for producing cores in a horizontal-type core box or a vertical-type core box, comprising:

a frame;

an extruding head carried by the frame and adapted to inject molding sand into a core box;

horizontal core box handling apparatus carried by the frame including a lifting platen for elevating a horizontal-type core box into a molding position and clamps disposed adjacent the frame for clamping a cope of the core box; and vertical core box handling apparatus carried by the frame including first and second vertical platens movable relative to one another and capable of supporting portions of a vertical-type core box;

wherein the horizontal core box handling apparatus is positioned so that it does not interfere with a vertical-type core box during production of cores therein and wherein the vertical core box handling apparatus is positioned so that it does not interfere with a horizontal-type core box during production of cores therein.

18. The core making machine of claim 17, further including a shuttle system capable of transporting a core box toward the molding position.

19. The core making machine of claim 17, wherein one of the vertical platens is pivotable about an axis between an upright orientation and a downward orientation and further including an actuator coupled to the one vertical platen that controls pivoting of the one vertical platen.

20. The core making machine of claim 19, further including a conveyor disposed below the one vertical platen

21. The core making machine of claim 20, wherein the conveyor is movable between upper and lower positions by a further actuator.

22. The core making machine of claim 19, further including an indexing system disposed below the one vertical platen.

23. The core making machine of claim 17, further including a vacuum pick-off unit disposed adjacent the frame.

* * * * *